United States Patent [19]

Pacáková et al. [45]

[11] Patent Number: 4,925,000

Date of Patent: May 15, 1990

[54] DEVICE FOR POSITIONING BOBBINS WITH YARN PACKAGES

[75] Inventors: Zdenka Pacáková, Červen Kostelec; Pavel Brokl, Jiráskova; Josef Kulhav, Žamberk, all of Czechoslovakia

[73] Assignee: Elitex, Koncern textilniho strojirenstvi, Czechoslovakia

[21] Appl. No.: 374,447

[22] Filed: Jun. 30, 1989

[30] Foreign Application Priority Data

Jul. 4, 1988 [CS] Czechoslovakia ..... 4814-88

[51] Int. Cl.[5] ..... B69G 47/24; D01H 9/18

[52] U.S. Cl. ..... 198/409; 198/448; 198/468.2; 198/463.3; 57/90; 57/281; 242/35.5 A

[58] Field of Search ..... 57/276, 281, 90; 242/35.5 R, 35.5 A; 198/448, 468.2, 409, 463.3; 209/427

[56] References Cited

U.S. PATENT DOCUMENTS

| | | | |
|---|---|---|---|
| 2,379,911 | 7/1945 | Kottmann | 198/463.3 X |
| 2,675,118 | 4/1954 | Morrison | 198/463.3 |
| 4,114,351 | 9/1978 | Morimoto et al. | 198/409 X |
| 4,382,500 | 5/1983 | Oyama et al. | 198/468.2 X |
| 4,496,110 | 1/1985 | Raasch et al. | 242/35.5 A |
| 4,565,278 | 1/1986 | Asai et al. | 242/35.5 A X |
| 4,650,062 | 3/1987 | Uchida | 198/468.2 |
| 4,763,773 | 8/1988 | Kawarabashi et al. | 198/409 |

FOREIGN PATENT DOCUMENTS

| | | | |
|---|---|---|---|
| 243522 | 12/1987 | Czechoslovakia . | |
| 3025793 | 2/1982 | Fed. Rep. of Germany | 198/409 |
| 3244015 | 6/1984 | Fed. Rep. of Germany . | |
| 3334977 | 11/1984 | Fed. Rep. of Germany . | |
| 3332409 | 1/1985 | Fed. Rep. of Germany . | |

*Primary Examiner*—Joseph J. Hail, III

*Attorney, Agent, or Firm*—Ostrolenk, Faber, Gerb & Soffen

[57] ABSTRACT

An object, such as a bobbin, is gripped at a location other than its center of gravity and lifted so as to rotate by gravity to a desired orientation. A carriage moves the bobbin toward a conveyor path and tilts the conveyor path into position to receive the bobbin. The bobbin is positioned on the conveyor path in the desired orientation while the conveyor path is in the receiving position.

12 Claims, 9 Drawing Sheets

DEVICE FOR POSITIONING BOBBINS WITH YARN PACKAGES

BACKGROUND OF THE INVENTION

1. Field of the Invention

The present invention relates to a device for positioning bobbins with yarn packages, particularly before such bobbins are withdrawn from a textile spinning machine.

2. Description of the Related Art

Certain methods and devices have been developed for positioning cone-shaped bobbins in open end spinning machines.

When the machine has two conveyer belts, positioning is performed, e.g., by transferring the bobbins from one belt to the other, the bobbins being thus turned through 180°. The bobbins are then delivered from the machine on only one belt. The advantage of this method is its easy practicability. Its disadvantage is that both belts must move to discharge the bobbins. This prolongs the time required to transfer the bobbins since all of the bobbins must be discharged on both belts together. When an automatic doffing device is used, a long delay is encountered.

In another known method of positioning bobbins, a device is used to determine the position of the bobbin on a single belt. Based on this determination, the bobbin is horizontally positioned by being lifted and turned through 180°. This method can only be used with conical bobbins. Cylindrical bobbins cannot be similarly positioned because of the location of their yarn reserve.

The specified methods of positioning bobbins do not, in any case, secure the exact position of the bobbin relative to the tube, which is a function of yarn winding diameter.

SUMMARY OF THE INVENTION

The present invention relates to a system for handling bobbins with yarn packages prior to automated withdrawal of the bobbins from a textile spinning machine, the system including: (A) a conveyor belt for conveying the bobbins to a first location; (B) an automated barrier for automatically stopping the conveyor belt when one of the bobbins arrives at the first location; (C) an independent withdrawal path for withdrawing the bobbin to a withdrawal location of the textile spinning machine; (D) tilting means for tilting the independent withdrawal path into position to receive the bobbin; (E) a movable transfer arm for lifting the bobbin from the first location and for positioning the bobbin on the independent withdrawal path in a desired orientation, the movable transfer arm including gripping arms for gripping the bobbin, the gripping arms including rotatable means for permitting the bobbin to rotate into a desired orientation when the bobbin is lifted from the first location; and (F) a movable carriage for supporting and moving the movable transfer arm into position above the independent withdrawal path, the movable carriage including actuating means for causing the tilting means to tilt the independent withdrawal path into position to receive the bobbin when the movable transfer arm is moved by the movable carriage into position above the independent withdrawal path.

Preferably, the withdrawal path includes rollers. Preferably, the transfer arm includes a lifting mechanism for lifting the gripping arms. Preferably, the lifting mechanism includes a pneumatic cylinder and an exchangeable stop for limiting the extent to which the mechanism can lift the gripping arms. Preferably, the gripping arms include pivotally mounted levers. Preferably, the rotatable means of the gripping arms include plates which rotate by gravity into a desired position. Preferably, the tilting means includes a leverage system which is connected to the withdrawal path and which is cooperable with the carriage. Preferably, the carriage includes a semicircular guideway for rotatably supporting the transfer area.

The present invention also relates to a method and an apparatus for handling an object, the method including: (A) gripping the object at a location other than the center of gravity of the object and lifting the object so that the object rotates by gravity to a desired orientation; (B) moving a carriage in a first direction to move the bobbin toward a conveyor path and to tilt the conveyor path into a receiving position to receive the bobbin; and (C) positioning the bobbin on the conveyor path while the conveyor path is in the receiving position.

The present invention makes it possible to position a series of bobbins with yarn packages into the required delivery position without fail. The present invention can be used with cylindrical and conical bobbins, regardless of whether the bobbins are situated on one belt or on two belts beside each other.

The bobbins, laid on the external diameter of their yarn winding, are positioned by lifting and reposing the bobbins, gripped at the yarn winding so as to divide the bobbin into two parts. The lighter part rotates upwardly to become the upper half of the bobbin, and the bobbin is laid on the yarn package face.

With the present invention, it is possible to similarly position both conical and cylindrical bobbins. It is also possible, by appropriately adjusting the device, to position the bobbins on an optional face. Further, with the present invention, the bobbins can be positioned from one belt of a machine or from two belts arranged beside each other. It is possible to situate the delivery of the bobbins at their positioning from one belt into the axis of the machine. When two belts are beside each other, the bobbins are usually only delivered through the axis of the machine, i.e., centrally between the two belts.

The above-identified operations can be performed by one device, but with different control programs.

Other features and advantages of the invention will become apparent from the following detailed description of preferred embodiments of the invention read in conjunction with the accompanying drawings.

DETAILED DESCRIPTION OF THE PREFERRED EMBODIMENTS

Figure 1:
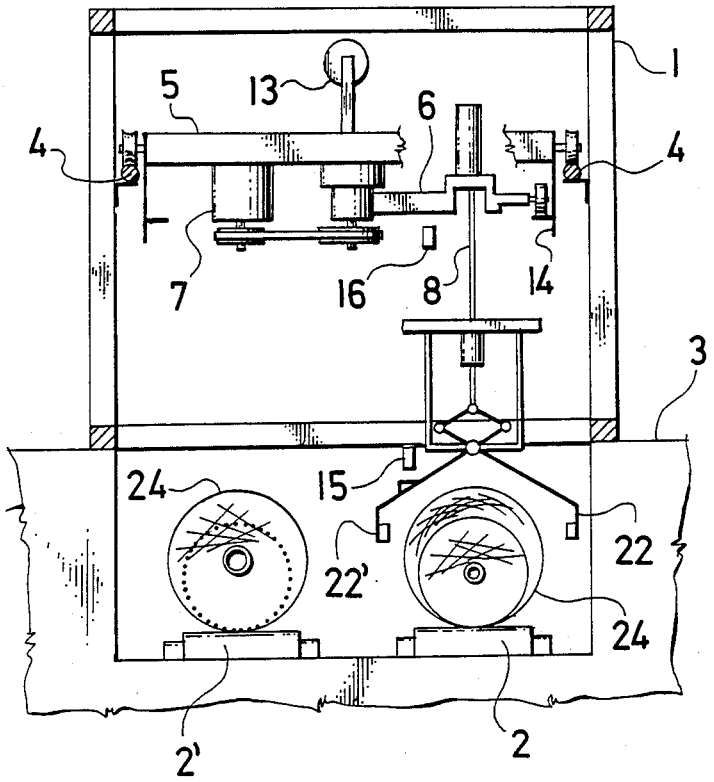
FIG. 1 is a front view of a bobbin positioning device in accordance with the invention.
Figure 2:
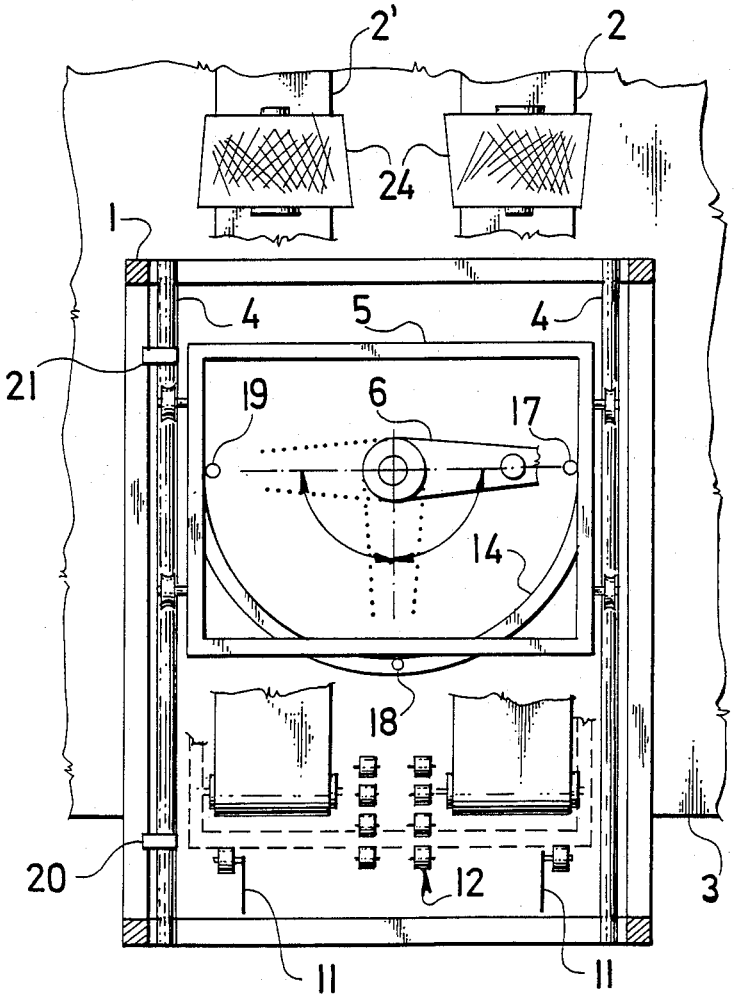
FIG. 2 is a plan view of the device of FIG. 1.
Figure 3:
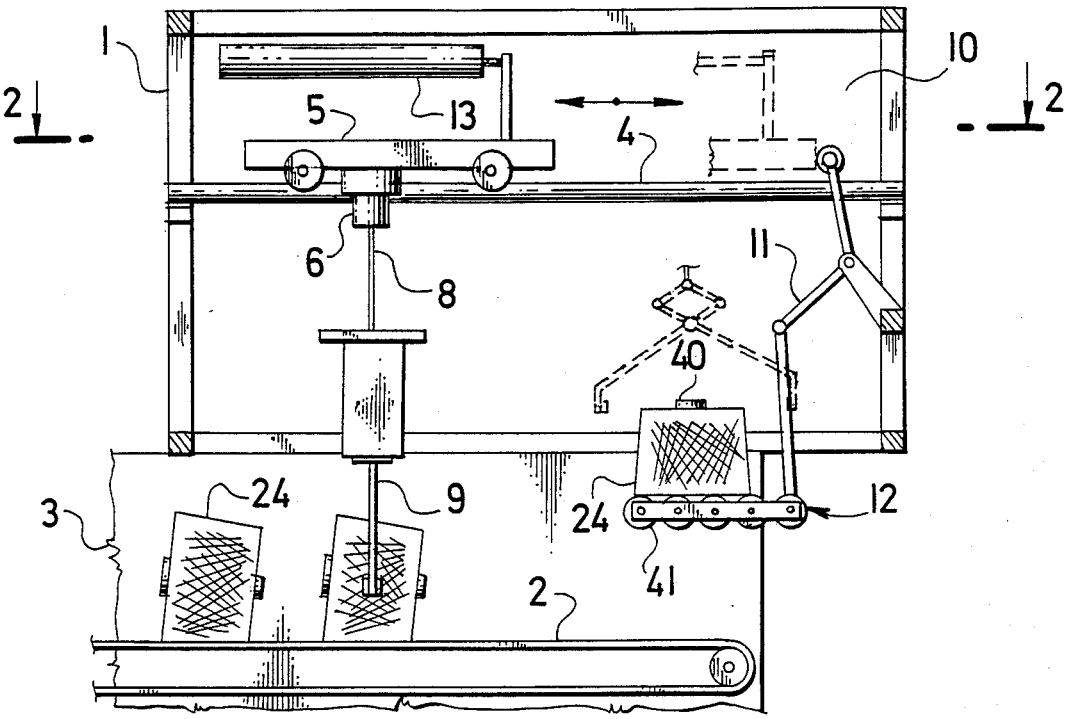
FIG. 3 is a side view of the device of FIG. 1.

Referring to FIGS. 1–3, a system in accordance with the invention includes a stationary frame 1. The frame 1 is mounted above conveying belts 2 and 2′ of a textile machine 3.

The frame 1 has guiding paths 4 which support the wheels of a movable carriage 5. The movable carriage 5 is displaced by a pneumatic cylinder 13. The movable carriage 5 in turn forms the base for a rotatably mounted arm 6. The arm 6 is rotated by a gear motor 7. The rotatable arm 6 is guided by a semicircular guideway 14 which is fastened to the movable carriage 5. A lifting mechanism 8 is fastened to the arm 6. The lifting mechanism 8 has gripping arms 9. A leverage system 11 and a path 12 are mounted in the front part 10 of the stationary frame 1. Sensors 15–21 are mounted so as to follow the extreme positions of the various parts of the system.

Figure 7:
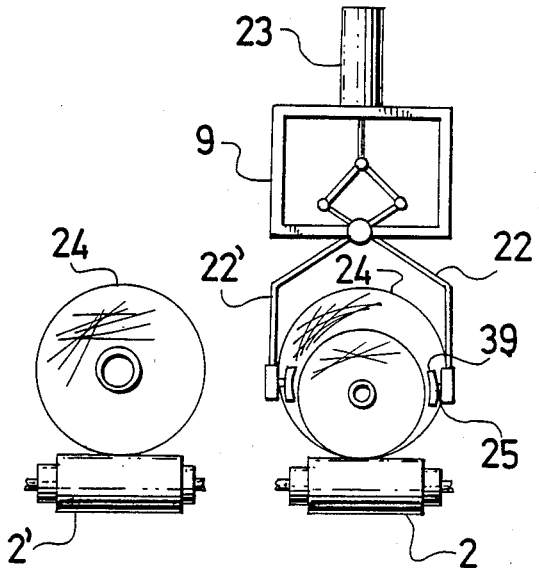
FIG. 7 is a detailed view of the gripping device and a method of gripping the bobbin on the right belt.
Figure 8:
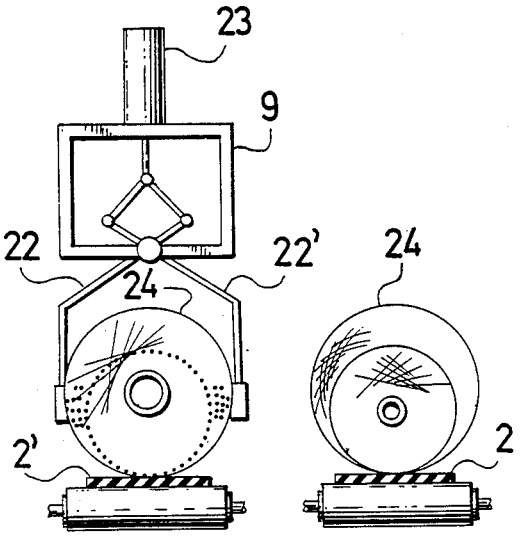
FIG. 8 is a detailed view of the gripping device turned through an angle of 180° and illustrates the method of gripping the bobbin on the left belt.

The gripping arms 9 (FIGS. 7 and 8) are formed by pivotally mounted levers 22 and 22′. These levers 22 and 22′ are controlled by a pneumatic cylinder 23. Each of the levers 22 and 22′ has a pivotally and swingingly mounted rock lever 25.

Figure 9:
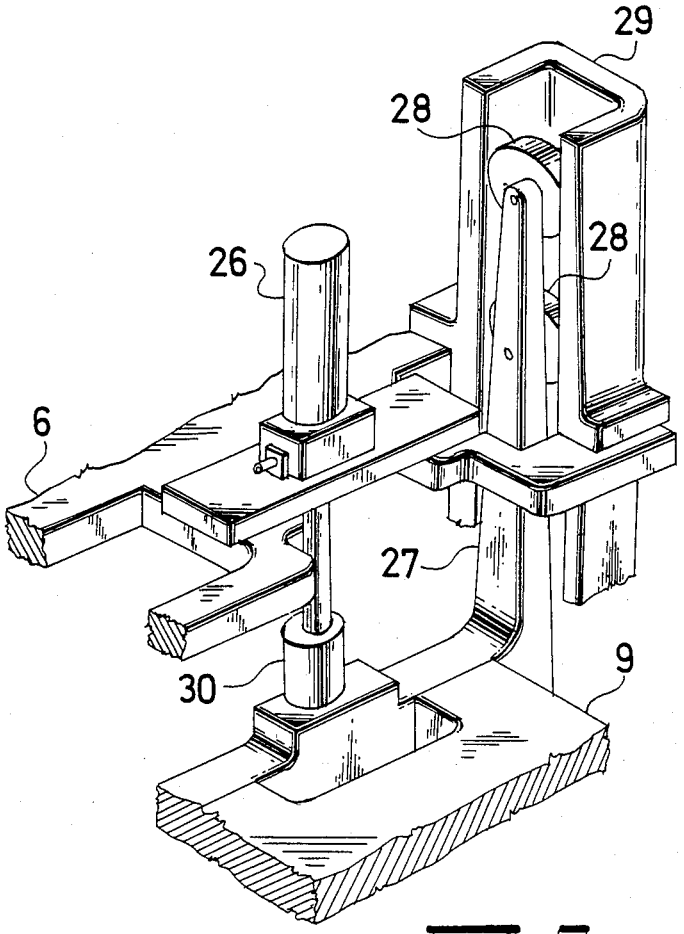
FIG. 9 is a detailed view of the lifting mechanism.

The lifting mechanism 8 (illustrated in detail in FIG. 9) includes a pneumatic cylinder 26 which is mounted to the rotatable arm 6. The lifting mechanism 8 further includes a holder 27 with guiding rollers 28. The rotatable arm 6 includes guideways 29 which bilaterally guide the holder 27. The stroke of the piston rod (not illustrated) of the pneumatic cylinder 26 is restricted by an exchangeable stop 30. The gripping arms 9 are mounted to the holder 27.

Figure 10:
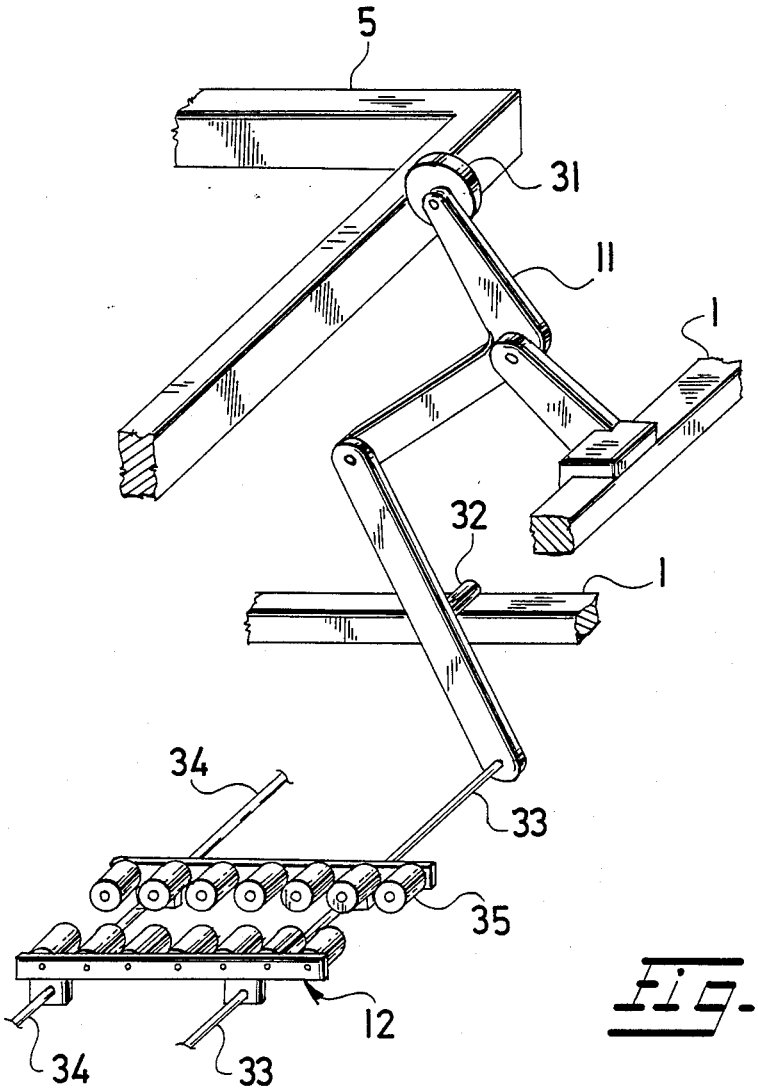
FIG. 10 is a detailed view of the leverage for lifting the path.

The leverage 11 (FIG. 10) forms part of the stationary frame 1 (FIG. 3). The leverage 11 is controlled by the movable carriage 5 via a rotatable roller 31. The leverage 11 is provided with a stop 32 for adjusting the lifting path 12. The path 12 is formed by a system of rotatable rollers 35 and is pivotally mounted on an axis 34. The axis 34 is connected to the stationary frame 1. The rollers 35 are fixed to the leverage 11 by a rod 33. The rollers 35 can be replaced by, e.g., a system of rods, a sliding surface, a short conveying belt, etc.

The pneumatic cylinders 13, 23, and 26 can be replaced by force members controlled by another medium, or by mechanical force members.

In operation, a bobbin 24 (FIGS. 1–3) (deposited on the conveyor belts 2 or 2′) is conveyed by one of the belts 2, 2′ to the point of withdrawal and positioning. Light barriers 36 and 37 (FIG. 6) are mounted in immediate proximity of the belts 2 and 2′. By means of the light barriers 36 and 37, the belt 2 or 2′ (with the bobbin 24 deposited thereon) is stopped so that the bobbin 24 is precisely located relative to the axis of rotation 38 of the rotatable arm 6.

Figure 4:
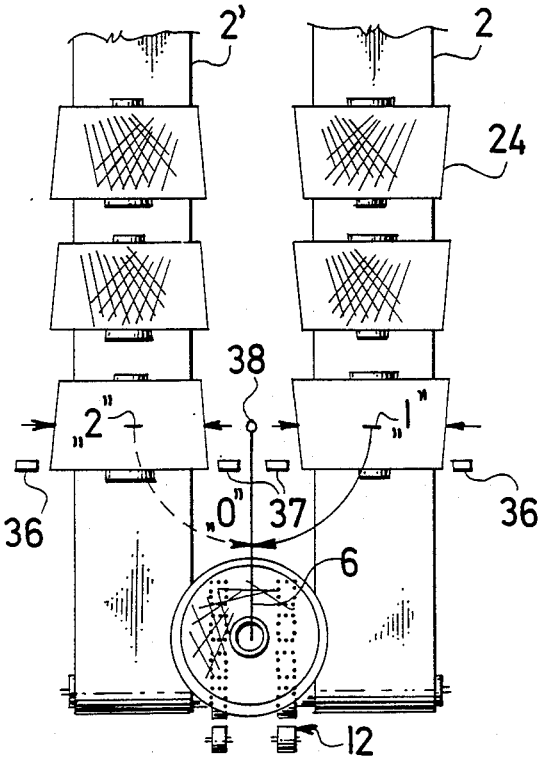
FIG. 4 illustrates the positioning of conical bobbins from the left or the right belt into the center of the machine.
Figure 5:
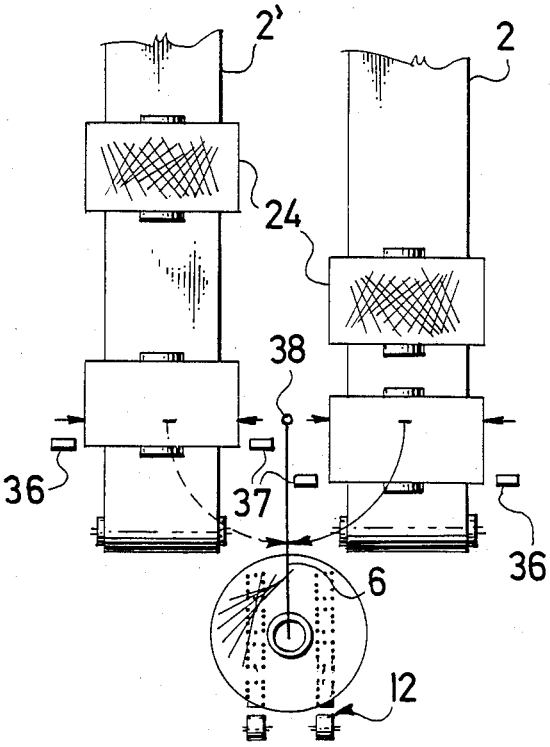
FIG. 5 illustrates the gripping point of the cylindrical bobbin and its positioning into the center of the machine.
Figure 6:
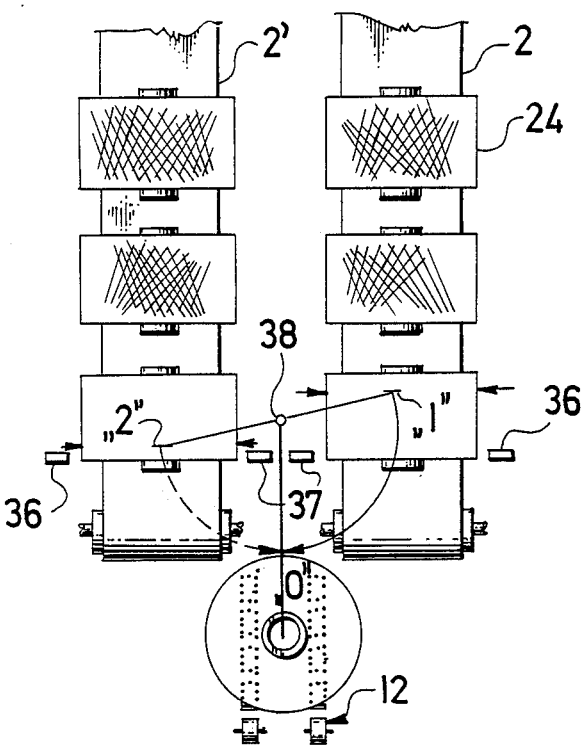
FIG. 6 illustrates another method of gripping cylindrical bobbins in which the gripping axis does not pass through the pivot point of an arm.

The individual variations with a conical or a cylindrical bobbin are represented in FIGS. 4–6.

For purposes of explanation, the following description refers to a bobbin which is initially conveyed on the right belt 2. The whole device is in an inoperative condition in the "initial position". The "initial position" is defined as follows: the movable carriage 5 is in the extreme rear position (FIGS. 2 and 3) (recorded by sensor 21); the rotatable arm 6 is in position "0" (recorded by sensor 18); the lifting mechanism 8 is in the upper position (recorded by sensor 16); and levers 22 and 22′ are open (recorded by sensor 15).

Upon stoppage of the bobbin 24 on the belt 2, the rotatable arm 6 is turned into position "1" and the lifting mechanism 8 and the gripping arms 9 are lowered. The bobbin 24 is lifted and the rotatable arm 6 is turned back into position "0". The movable carriage 5 is then transferred into the front part 10 of the stationary frame 1 (FIG. 3) (recorded by sensor 20) (FIG. 2). The swingable and pivotable levers 25 make it possible to turn the bobbin 24 through 90° into position with respect to the axis of the vertical tube 40 as the arm 6 is rotated from position "1" to position "0". Thus, the lighter part of the bobbin becomes its upper half as the bobbin is laid on its face 41.

The movable carriage 5 lifts the path 12 with its front side by means of the leverage 11 and the rotatable roller 31. The bobbin 24 is transferred above the path 12 and is then released by opening the gripping arms 9. The arm 6 returns from position "0" into position "1". During this movement, the plate 39 of the pivotable and swingable lever 25 returns by gravity into its original position. The movable carriage 5 returns to the initial position and releases the leverage 11. As a result, the front part of the path 12 is tilted, causing the bobbin 24 to leave the path 12 in a precisely defined position, guided behind the tube 40 by the rollers 35.

When a further bobbin is positioned, the whole process is repeated until the belt 2 is emptied. When the belt is emptied, the device is returned to the initial position. To position bobbins 24 from the belt 2′, the cycle is the same, except that the rotatable arm 6 turns through 90° between the positions "0" and "2".

By changing the program for controlling the whole device, and by adding a further path 12′, it is possible to perform positioning from each belt 2 or 2′ onto independent paths.

The positioned bobbins 24, which leave the machine 3 by means of the path 12, are prepared for automated withdrawal by a further device, either a conveying belt or a robot, or a still further device.

Although the invention has been described and illustrated in detail, it is clearly understood that the same is by way of illustration and example only and is not to be taken by way of limitation. The spirit and scope of the invention should be limited only by the appended claims.

We claim:

1. A system for handling bobbins with yarn packages prior to automated withdrawal of the bobbins from a textile spinning machine, said system comprising:

(A) a conveyor belt for conveying the bobbins to a first location;

(B) an automated barrier for automatically stopping said conveyor belt when one of the bobbins arrives at said first location;

(C) an independent withdrawal path for withdrawing the bobbin to a withdrawal location of the textile spinning machine;

(D) tilting means for tilting said independent withdrawal path into position to receive the bobbin;

(E) a movable transfer arm for lifting the bobbin from said first location and for positioning the bobbin on said independent withdrawal path in a desired orientation, said movable transfer arm including gripping arms for gripping the bobbin, said gripping arms including rotatable means for permitting the bobbin to rotate into the desired orientation when the bobbin is lifted from said first location; and (F) a movable carriage for supporting and moving said movable transfer arm into position above said independent withdrawal path, said movable carriage including actuating means for causing said tilting means to tilt said independent withdrawal path into position to receive the bobbin when said movable transfer arm is moved by said movable carriage into position above said independent withdrawal path.

2. The system of claim 1, wherein said withdrawal path includes rollers.

3. The system of claim 1, wherein said transfer arm includes a lifting mechanism for lifting said gripping arms.

4. The system of claim 3, wherein said lifting mechanism includes a pneumatic cylinder and an exchangeable stop for limiting the extent to which said mechanism can lift said gripping arms.

5. The system of claim 4, wherein said gripping arms include pivotally mounted levers.

6. The system of claim 1, wherein said rotatable means of said gripping arms include plates which rotate by gravity into a desired position.

7. The system of claim 1, wherein said tilting means includes a leverage system which is connected to said withdrawal path and which is cooperable with said carriage.

8. The system of claim 1, wherein said carriage includes a semicircular guideway for rotatably supporting said transfer arm.

9. A method of handling an object, said method comprising the steps of:

(A) gripping said object at a location other than the center of gravity of said object and lifting said object so that said object rotates by gravity to a desired orientation;

(B) moving a carriage in a first direction to move said object toward a conveyor path and engaging a means for tilting said conveyor path into a receiving position to receive said object; and (C) positioning said object on said conveyor path while said conveyor path is in said receiving position.

10. The method of claim 9, wherein said object is a bobbin with a conical yarn package.

11. The method of claim 9, wherein said object is a bobbin with a cylindrical yarn package.

12. An apparatus for handling an object, comprising:

(A) means for gripping the object at a location other than the center of gravity of the object and for lifting the object so that the object rotates by gravity to a desired orientation;

(B) a carriage which is movable in a first direction to move the object toward a conveyor path and engaging a means for tilting the conveyor path into a receiving position to receive the object; and (C) positioning means for positioning the object on the conveyor path while the conveyor path is in the receiving position.

* * * * *